US008430071B2

(12) United States Patent
Carlson et al.

(10) Patent No.: US 8,430,071 B2
(45) Date of Patent: Apr. 30, 2013

(54) ENGINE COOLING SYSTEM FOR A VEHICLE

(75) Inventors: Michael H. Carlson, Madison Heights, MI (US); George T Washburn, Royal Oak, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 264 days.

(21) Appl. No.: 12/500,737

(22) Filed: Jul. 10, 2009

(65) Prior Publication Data

US 2011/0005474 A1 Jan. 13, 2011

(51) Int. Cl.
*F01P 7/14* (2006.01)

(52) U.S. Cl.
USPC ..... 123/41.44; 123/41.1; 123/41.47; 236/34.5

(58) Field of Classification Search ..... 123/41.09, 123/41.29, 41.31, 41.05, 41.08, 41.16, 41.1, 123/563, 568.12, 41.44, 41.47; 60/321, 605.2; 165/297; 236/68 R, 34.5, 101 R; 62/101, 62/148, 232, 238.3, 476, 484
See application file for complete search history.

(56) References Cited

U.S. PATENT DOCUMENTS

| | | | | |
|---|---|---|---|---|
| 4,526,257 | A | 7/1985 | Mueller | |
| 4,621,594 | A * | 11/1986 | Kubis | 123/41.09 |
| 2004/0182097 | A1 * | 9/2004 | La Falce et al. | 62/226 |
| 2008/0217083 | A1 * | 9/2008 | Serkh et al. | 180/165 |

FOREIGN PATENT DOCUMENTS

| | | | |
|---|---|---|---|
| CN | 101233338 | A | 7/2008 |
| DE | 10037823 | A1 | 2/2002 |
| DE | 10143109 | A1 | 3/2003 |
| DE | 102005003881 | A1 | 7/2006 |

* cited by examiner

*Primary Examiner* — Noah Kamen

(57) ABSTRACT

An engine cooling system for a vehicle, and method of operation, includes both an engine driven main coolant pump that may be disengaged by a clutch and an electrically driven auxiliary coolant pump, where each can be used separately or they can be used together to control the amount of coolant flow through the engine cooling system.

14 Claims, 3 Drawing Sheets

ENGINE COOLING SYSTEM FOR A VEHICLE

BACKGROUND OF INVENTION

The present invention relates generally to coolant systems for cooling an engine in a vehicle.

Engine coolant pumps (also called water pumps) are employed to pump a coolant through the engine to cool the engine and pump coolant through a heater core to provide heat to a vehicle passenger compartment. These pumps are conventionally driven off of the engine, so they pump continuously when the engine is on. Moreover, the speed of these engine driven coolant pumps is based on the speed of the engine. This method of operating the pump does not lead to the most fuel efficient vehicle operation.

In order to improve the vehicle fuel economy, then, some have replaced a conventional engine driven coolant pump with a coolant pump that is driven by an electric motor. This allows the speed of the pump to be varied according to the amount of coolant flow needed at any particular time to meet vehicle thermal requirements. However, relatively high electric loads and large, expensive electrically driven pumps are sometimes required to meet the peak demand for coolant flow. This high electric load and expensive, large, electrically driven pump is undesirable for some vehicles. Accordingly, it is desirable to meet engine cooling and passenger compartment warming needs while maximizing vehicle fuel economy and minimizing peak electric loads needed for pumping coolant.

SUMMARY OF INVENTION

An embodiment contemplates an engine cooling system for a vehicle having an internal combustion engine. The engine cooling system may include a main coolant pump having an inlet and an outlet that pumps coolant into the internal combustion engine; a torque transfer assembly driven by the engine and engaging the main coolant pump to transfer torque from the internal combustion engine to the main coolant pump; and a clutch connected between the main coolant pump and the torque transfer assembly to selectively disengage the main coolant pump from the torque transfer assembly. The engine cooling system may also include a thermostat having a thermostat outlet connected to the inlet of the main coolant pump, a first inlet and a second inlet, with the thermostat operable to selectively prevent coolant flow from the first inlet to the thermostat outlet; and a radiator that receives the coolant from the internal combustion engine and directs the coolant to the first inlet. The engine cooling system may also include a heater core located in a HVAC module, and an electrically driven auxiliary coolant pump configured such that the coolant flowing through the auxiliary coolant pump and the heater core is directed into the second inlet of the thermostat.

An embodiment contemplates a method of operating an engine cooling system in a vehicle having an internal combustion engine, the method comprising the steps of: determining if no coolant flow is required during operation of the engine; disengaging a main pump clutch to prevent a torque produced by the engine to drive a main coolant pump and ceasing operation of an auxiliary pump motor to deactivate an auxiliary coolant pump, if the determination is made that no coolant flow is required; determining if a minimum coolant flow is required in the engine cooling system; disengaging the main pump clutch to prevent the torque produced by the engine to drive the main coolant pump and activating the auxiliary pump motor to drive the auxiliary coolant pump, if the determination is made that the minimum coolant flow is required in the engine cooling system; determining if a maximum coolant flow is required in the engine cooling system during operation of the engine; engaging the main pump clutch to cause the engine to drive the main coolant pump and activating the auxiliary pump motor to drive the auxiliary coolant pump, if the determination is made that the maximum coolant flow is required in the engine cooling system; determining if a normal coolant flow is required in the engine cooling system during operation of the engine, the normal coolant flow being a greater coolant flow than the minimum coolant flow and less coolant flow than the maximum coolant flow; and engaging the main pump clutch to cause the engine to drive the main coolant pump and ceasing operation of the auxiliary pump motor to deactivate the auxiliary coolant pump, if the determination is made that the normal coolant flow is required in the engine cooling system.

An advantage of an embodiment is that a clutch controlled, engine driven coolant pump in combination with an electrically driven auxiliary coolant pump may offer a low cost way to improve the overall fuel efficiency of the vehicle while not overtaxing the vehicle electrical system. Moreover, this is accomplished while assuring adequate heat transfer for the engine cooling function and the HVAC (heating, ventilation and air conditioning) heating function. The main engine driven coolant pump may be disengaged under many vehicle operating conditions, with the auxiliary coolant pump providing sufficient coolant flow to meet heat transfer requirements under these conditions.

DETAILED DESCRIPTION

Figure 1:
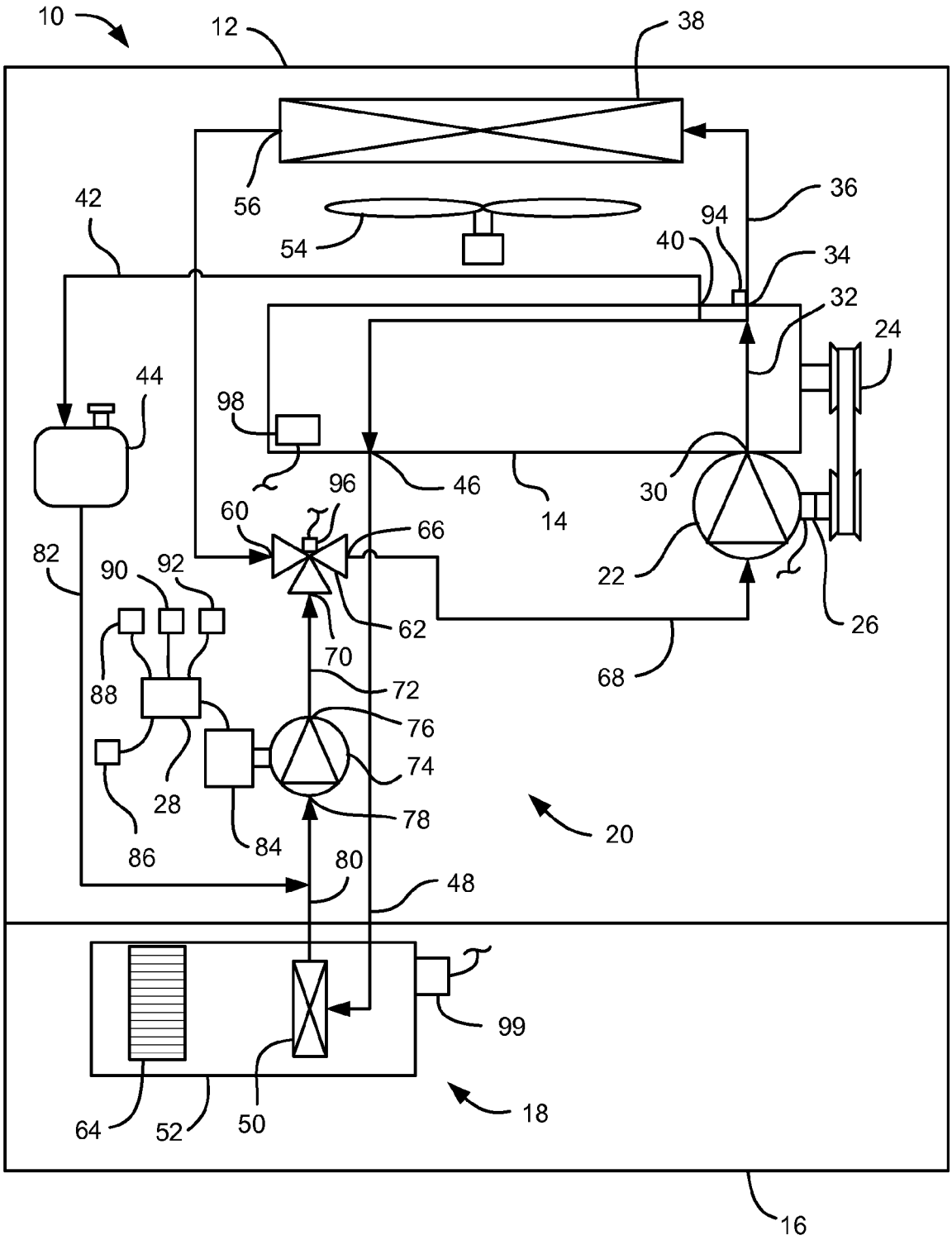
FIG. 1 is a schematic view of a portion of a vehicle and an engine cooling system.

Referring to FIG. 1, a vehicle, indicated generally at 10, is shown. The vehicle 10 may include an engine compartment 12, including an internal combustion engine 14, and a passenger compartment 16, which may include a portion of a HVAC (heating, ventilation and air conditioning) system 18. The vehicle also includes an engine cooling system 20 that employs a coolant for providing cooling of the engine 14 and heat for the HVAC system 18. The coolant may be a conventional liquid mixture such as an ethylene glycol and water mix, or may be some other type of liquid with suitable heat transfer characteristics. Solid lines with arrows in FIG. 1 indicate coolant flow paths and the direction that coolant may flow along these flow paths under various operating modes.

The engine cooling system 20 includes a main coolant pump 22 that is driven by the engine 14 via a torque transfer assembly 24 such as a belt and pulley system. This torque transfer assembly 24 may also be a chain and sprocket assembly, gears or other torque transfer means known to those skilled in the art for transferring torque from the internal combustion engine 14 to a coolant pump. A clutch 26 is located between the torque transfer assembly 24 and the main coolant pump 22 and electronically controlled by a controller 28, which selectively allows the main coolant pump 22 to be driven by the engine 14 or disconnected from the engine torque when the pump 22 is not needed. An output 30 of the main coolant pump 22 directs coolant into engine internal coolant flow channels 32 of the engine 14. The internal coolant flow channels 32 have a first engine output 34 to a water line 36 that directs the coolant to a radiator 38, a second engine output 40 to a coolant vent line 42 that directs the coolant to a surge tank 44, and a third engine output 46 to a coolant line 48 that directs the coolant to a heater core 50 in a HVAC module 52 of the HVAC system 18. The HVAC module 52 may also include a blower 64 that can selectively force air through the heater core 50. Alternatively, an overflow bottle (not shown) or similar device may be employed instead of the surge tank.

An engine fan 54 may be located adjacent to the radiator 38 and is operable to draw air through the radiator 38. The radiator 38 includes an outlet 56 to a coolant line that directs the coolant to a first inlet 60 to a thermostat 62. The thermostat 62 may be one that actuates based on a fixed, predetermined coolant temperature or may be an electrically controlled type that allows for electronic adjustment of the temperature at which the thermostat 62 opens. An outlet 66 from the thermostat 62 connects to a coolant line 68 that directs the coolant to the main coolant pump 22. A second inlet 70 to the thermostat 62 is connected to a coolant line 72 that directs coolant to the thermostat 62 from an outlet 76 of an auxiliary coolant pump 74. The auxiliary coolant pump 74 may have a significantly smaller coolant pumping capacity than the main coolant pump 22. Alternatively, the thermostat may be placed at the outlet of the engine (prior to coolant flow into the radiator), with the flow from the auxiliary coolant pump connecting to the coolant line directing coolant into the main coolant pump.

The auxiliary coolant pump 74 also includes an inlet 78 connected to a coolant line 80 directing coolant from the heater core 50. A vent line 82 directs coolant from the surge tank 44 to the coolant line 80. An electric motor 84 connects to and drives the auxiliary coolant pump 74. The controller 28 may control this motor 84. This motor control may be a relay type, with on-off control at a predetermined speed, or may be a variable speed type of control where the motor 84 can drive the auxiliary pump 74 at variable speeds depending upon the amount of coolant flow desired.

The controller 28 may also have various inputs that are employed when determining the desired operating states for the main coolant pump 22 (via clutch engagement/disengagement) and the auxiliary coolant pump 74 (via motor operation). The inputs may include, for example, an engine speed input 86, an engine load input 88, a throttle position input 90, and a fueling status input 92. Also, an engine outlet temperature 94 (indicating a coolant temperature) and a thermostat position 96 may be input to the controller 28. A temperature sensor 98 may communicate a temperature for the engine 14 to the controller 28. An HVAC controller 99 may communicate climate flow request information to the controller 28. The controller 28 may be made up of multiple separate processors and may be any combination of hardware and software as is known to those skilled in the art.

The arrangement of components in the engine cooling system 20 and the ability to separately control the activation of the main coolant pump 22 and the auxiliary coolant pump 74, allows for variation in coolant flow rates through various portions of the system 20. This allows for coolant flow where and when it is needed. For example, in a vehicle operating situation where the thermostat 62 is closed and the auxiliary coolant pump 74, the main coolant pump 22, or both are activated, essentially all of the coolant flow will be pumped through the heater core 50, the engine internal coolant channels 32 and coolant lines 48, 68, 72 and 80. The amount of coolant flow will depend upon which coolant pumps are activated and the speed of the auxiliary coolant pump 74 (if variable speed is employed).

In another vehicle operating situation, where the thermostat 62 is open, the auxiliary coolant pump 74 is activated, and the main coolant pump 22 is off, all of the coolant will flow through the coolant line 68, with most of the coolant also flowing through the coolant lines 48, 72 and 80. Some of the coolant will flow through the internal coolant flow channels 32 and some of the coolant will flow through the radiator 38. For another vehicle operating situation, where the thermostat 62 is open, the auxiliary coolant pump is off, and the main coolant pump 22 is activated, again all of the coolant will flow through the coolant line 68, with most of the coolant flowing through the radiator 38 as well. Some of the coolant will flow through the lines 48, 72, 80 for the heater core 50 and auxiliary coolant pump 74. With the main coolant pump 22 activated, the coolant flow is greater than the previous example with only the auxiliary coolant pump 74 activated.

Figure 2A:
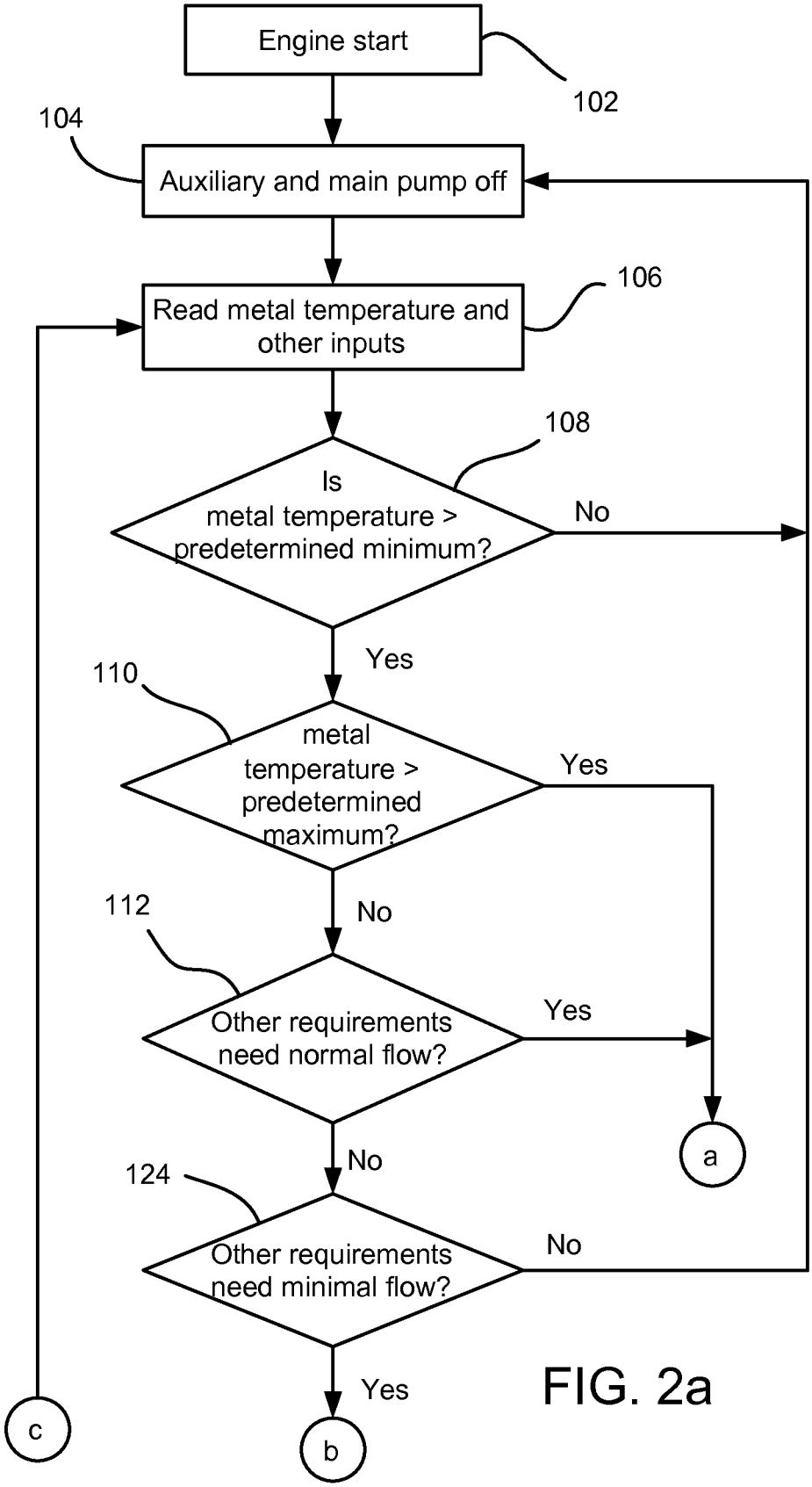
FIGS. 2*a* and 2*b* are a flow chart illustrating a process for operating an engine cooling system.
Figure 2B:
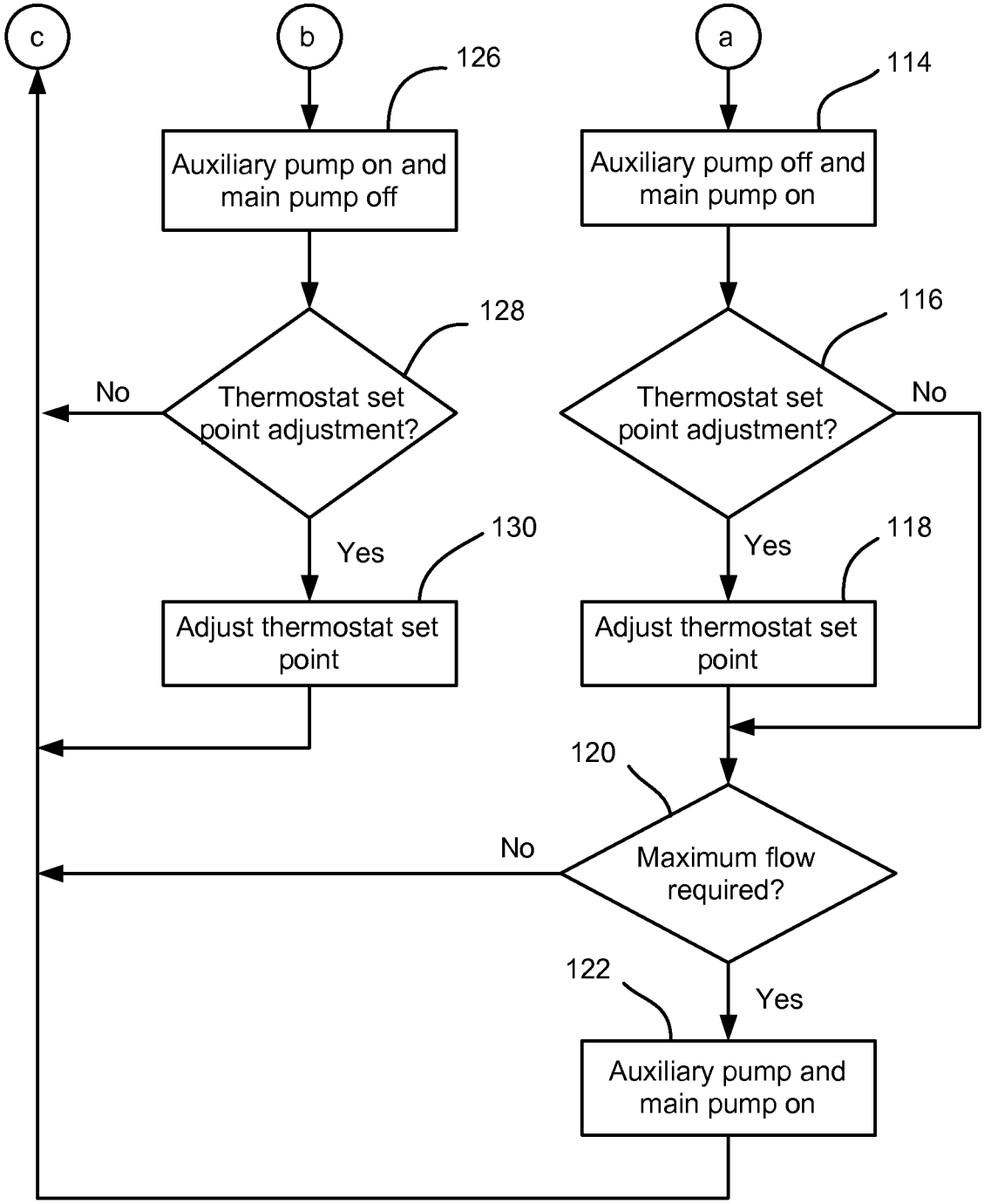

FIGS. 2*a* and 2*b* are a flow chart illustrating a process for operating the engine cooling system 20 of FIG. 1. At engine start, block 102, the auxiliary coolant pump and the main coolant pump are off, block 104. The auxiliary coolant pump being off means that the controller does not activate the motor and the main coolant pump being off means that the clutch is disengaged. The metal temperature and other inputs are read, block 106. The other inputs may include, for example, the HVAC system coolant flow request, the engine outlet temperature of the coolant, the position of the thermostat, the engine speed, the engine load, the fueling status and the throttle position. A determination is made as to whether the metal temperature is greater than a predetermined minimum temperature, block 108. If not, then the process returns to block 104.

If the metal temperature is greater than a predetermine minimum, then a determination is made as to whether the metal temperature is greater than a predetermined maximum temperature, block 110. If it is not, then a determination is made as to whether other vehicle operation requirements will require a normal flow of coolant (i.e., more than a minimal coolant flow but less than maximum coolant flow), block 112. Under some operating conditions, more than a minimum flow may be required to meet powertrain cooling or passenger compartment comfort needs. The other conditions for normal flow might be, for example, when the HVAC system is requesting a high flow rate (i.e., maximum heat with high blower speed), when the metal temperature has reached localized boiling conditions, when the coolant temperature is high enough that the thermostat is open and the engine fan is needed to cool the coolant in the radiator, when the engine load is high enough that the engine needs the higher flow (e.g., towing a trailer or driving on long uphill grades), and when the engine speed is high so that additional engine cooling is needed.

If the metal temperature is greater than the predetermined maximum temperature, block 110, or the other requirements need normal flow, block 112, then the auxiliary coolant pump is turned off and the main coolant pump is activated (i.e., the clutch is engaged), block 114.

If the thermostat is an adjustable electronic thermostat, then a determination is made as to whether the thermostat set point needs adjusting, block 116. If so, then the thermostat set point is adjusted, block 118. The set point is the temperature at which the thermostat opens. Conditions under which the thermostat set point may change include, for example, high engine load or high ambient temperatures, where the thermostat set point is lowered so that it opens at a lower temperature to improve the heat transfer to the radiator. This may delay the need to engage the main coolant pump, allowing operations with just the auxiliary coolant pump for a longer period. An example of another condition is when the vehicle is operating under low engine load or low ambient temperature, in which case the thermostat set point is raised so that the thermostat is held closed until much higher coolant temperature is achieved in order to improve engine efficiency and to prevent waste heat from escaping.

A determination is made as to whether maximum coolant flow is required, block 120. Operating conditions where maximum coolant flow may be needed include, for example, when the HVAC system has requested maximum flow, when the coolant temperature is at the boiling point and the engine is operating at a low speed, and when the vehicle is idling after towing a trailer up a hill. If maximum coolant flow is required, then both the auxiliary coolant pump and the main coolant pump are activated, block 122. If not, then the process returns to block 106.

If the metal temperature is not greater than the predetermined maximum temperature, block 110, and the other requirements do not need normal coolant flow, block 112, then a determination is made as to whether other requirements need minimal coolant flow, block 124. Such minimal flow requirements may be, for example, to meet moderate climate control flow requests, when the metal temperature is approaching localized boiling conditions, when the thermostat is just starting to open, and when the engine load or engine speed is high enough that some minimal coolant flow is needed to prevent engine hot spots from developing. If not, then the process returns to block 104, with the auxiliary and main coolant pumps off. If minimal coolant flow is needed, then the auxiliary coolant pump is activated (i.e., the controller activates the motor) and the main coolant pump is turned off, block 126. If the thermostat is an adjustable electronic thermostat, then a determination is made as to whether the thermostat set point needs adjusting, block 128. If so, then the thermostat set point is adjusted, block 130, and the process returns to block 106.

In addition to the above noted operating conditions, there may be vehicle operating conditions where a switch from normal to minimum flow for short periods of time is desired in order to reduce the load on the engine (i.e., disengage the main coolant pump clutch). For example, during a high acceleration event (where the throttle position shows a high acceleration demand from the vehicle operator), the main coolant pump clutch may be disengaged and the auxiliary coolant pump activated to allow the engine time to compensate for the abrupt load changes. Another example is the operating condition where the engine is in a vehicle deceleration, fuel cut off, or engine auto-stop condition, where the main coolant pump clutch may be disengaged and the auxiliary coolant pump activated.

While certain embodiments of the present invention have been described in detail, those familiar with the art to which this invention relates will recognize various alternative designs and embodiments for practicing the invention as defined by the following claims.

What is claimed is:

1. An engine cooling system for a vehicle having an internal combustion engine comprising:

a main coolant pump having an inlet and an outlet configured to pump a coolant into the internal combustion engine;

a torque transfer assembly driven by the engine and operatively engaging the main coolant pump to transfer torque from the internal combustion engine to the main coolant pump;

a clutch connected between the main coolant pump and the torque transfer assembly and operable to selectively disengage the main coolant pump from the torque transfer assembly;

a thermostat having a thermostat outlet connected to the inlet of the main coolant pump, a first inlet and a second inlet, the thermostat operable to selectively prevent coolant flow from the first inlet to the thermostat outlet;

a radiator configured to receive the coolant from the internal combustion engine and direct the coolant to the first inlet;

a heater core located in a HVAC module; and an electrically driven auxiliary coolant pump configured such that the coolant flowing through the auxiliary coolant pump and the heater core is directed into the second inlet of the thermostat.

2. The engine cooling system of claim 1 wherein the main coolant pump has a first pumping capacity and the auxiliary coolant pump has a second pumping capacity that is less than the first pumping capacity.

3. The engine cooling system of claim 1 including an electric motor configured to drive the auxiliary coolant pump.

4. The engine cooling system of claim 3 including a controller operatively engaging the clutch and the electric motor and operable to selectively cause the clutch to engage and disengage and the motor to start and stop.

5. The engine cooling system of claim 1 wherein the torque transfer assembly is a belt and pulley system configured to be driven by the internal combustion engine.

6. A method of operating an engine cooling system in a vehicle having an internal combustion engine, the method comprising the steps of:

(a) determining if no coolant flow is required during operation of the engine;

(b) disengaging a main pump clutch to prevent a torque produced by the engine to drive a main coolant pump and ceasing operation of an auxiliary pump motor to deactivate an auxiliary coolant pump, if the determination is made that no coolant flow is required;

(c) determining if a minimum coolant flow is required in the engine cooling system;

(d) disengaging the main pump clutch to prevent the torque produced by the engine to drive the main coolant pump and activating the auxiliary pump motor to drive the auxiliary coolant pump, if the determination is made that the minimum coolant flow is required in the engine cooling system;

(e) determining if a maximum coolant flow is required in the engine cooling system during operation of the engine;

(f) engaging the main pump clutch to cause the engine to drive the main coolant pump and activating the auxiliary pump motor to drive the auxiliary coolant pump, if the determination is made that the maximum coolant flow is required in the engine cooling system;

(g) determining if a normal coolant flow is required in the engine cooling system during operation of the engine, the normal coolant flow being a greater coolant flow than the minimum coolant flow and less coolant flow than the maximum coolant flow; and (h) engaging the main pump clutch to cause the engine to drive the main coolant pump and ceasing operation of the auxiliary pump motor to deactivate the auxiliary coolant pump, if the determination is made that the normal coolant flow is required in the engine cooling system.

7. The method of claim 6 wherein step (a) is further defined by a metal temperature being less than a predetermined threshold temperature and a HVAC system not requiring coolant flow through a heater core.

8. The method of claim 6 including step (i): adjusting a thermostat set point based on vehicle operating conditions.

9. The method of claim 6 wherein step (c) is further defined by minimum coolant flow being required when a metal temperature is below localized coolant boiling conditions and a climate control coolant flow request is below a predetermined level of climate control coolant flow.

10. The method of claim 6 wherein step (e) is further defined by maximum coolant flow being required when a climate control coolant flow request is at a maximum level of climate control coolant flow.

11. The method of claim 6 wherein step (e) is further defined by maximum coolant flow being required when a coolant temperature in the engine is at a boiling point and the internal combustion engine is operating below a predetermined low engine speed.

12. The method of claim 6 wherein step (g) is further defined by normal coolant flow being required when a coolant temperature is high enough that a thermostat is open and an engine fan is activated to improve cooling in a radiator.

13. The method of claim 6 including:

(i) detecting if a high vehicle acceleration event is occurring while the main pump clutch is engaged; and (j) disengaging the main pump clutch and activating the auxiliary pump motor for a predetermined time period if the high vehicle acceleration event is detected while the main pump clutch is engaged.

14. The method of claim 6 including:

(i) detecting an engine auto-stop condition while the vehicle is operating and the main pump clutch is engaged; and (j) disengaging the main pump clutch and activating the auxiliary pump motor during the engine auto-stop condition if the vehicle is operating and the main pump clutch is engaged.

* * * * *